US005746145A

United States Patent [19]

Cox et al.

[11] Patent Number: 5,746,145

[45] Date of Patent: May 5, 1998

[54] STITCH QUALITY MONITORING SYSTEM FOR SEWING MACHINES

[75] Inventors: Robert N. Cox, Raleigh; Timothy G. Clapp, New Hill; Kimberly J. Titus, Raleigh, all of N.C.

[73] Assignee: North Carolina State University, Raleigh, N.C.

[21] Appl. No.: 649,526

[22] Filed: May 17, 1996

[51] Int. Cl.[6] ..... D05B 69/36

[52] U.S. Cl. ..... 112/278

[58] Field of Search ..... 112/278, 273; 200/61.18, 61.13; 250/559.01

[56] References Cited

U.S. PATENT DOCUMENTS

| | | | |
|---|---|---|---|
| 4,429,651 | 2/1984 | Tajima | 112/273 |
| 4,938,159 | 7/1990 | Shibata | 112/273 |
| 5,233,936 | 8/1993 | Bellio | 112/278 X |

OTHER PUBLICATIONS

Publication by J. Lewis Dorrity and L. Howard Olson, Thread Motion Ratio Used to Monitor Sewing Machines, *Textile Process Control 2001 International Conference*, Manchester, England (May 18, 1995).

*Primary Examiner*—Peter Nerbun

*Attorney, Agent, or Firm*—Richard E. Jenkins, P.A.

[57] ABSTRACT

Stitch quality monitoring system for use in combination with a sewing machine having one or more stitch threads and comprising sensor means for at least one of said one or more stitch threads for detecting thread motion during each sewing stitch cycle. Encoder means is operatively associated with the sewing machine for creating a predetermined constant number of sensor means sampling signals for each stitch cycle of the sewing machine, and circuit means is electrically connected to the sensor means and encoder means for detecting stitch defects during the formation of potentially defective stitches.

26 Claims, 7 Drawing Sheets

STITCH QUALITY MONITORING SYSTEM FOR SEWING MACHINES

GOVERNMENT INTEREST

This invention was made with Government support under Contract No. 533798-83802 awarded by the Department of Commerce. The Government has certain rights in this invention.

TECHNICAL FIELD

The present invention relates generally to stitch quality monitoring in apparel manufacturing. More particularly, the present invention relates to a real time stitch quality monitoring system for sewing machines, particularly sewing machines used in manual or automated apparel manufacturing.

RELATED ART

As is well known to those skilled in the textile and apparel manufacturing arts, a great deal of research has been undertaken over the last several decades to obtain a better understanding of the complex interactions involved in joining two or more plies of material with the thread during high speed sewing. Although nearly two centuries have passed since the invention of the basic sewing machine, rigorous scientific analysis of the operation of the sewing machine did not begin until recently when sewing machine speeds increased up to and beyond ten thousand (10,000) stitches per minute. At this sewing speed, the number of problems related to sewability increases significantly due to the higher machine speeds and the newer types of textile materials being stitched together.

Apparel assembly is a key segment of the textile industry, and the sewing machine is at the heart of the apparel assembly process. The aforementioned high speed sewing machine development has served to increase both the speed and quality of the sewing process in apparel assembly, but many challenges remain in the sewing process including improved stitch quality monitoring wherein the presence of stitch defects is detected in real time as the stitches are constructed by a sewing machine. This would allow operators to be immediately informed concerning the presence of sewing stitch defects, and is very much needed for quality control in manual and automated apparel manufacture since it provides for correcting stitch defects before the apparel product proceeds downstream and yields an off-quality item.

Thus, it can be appreciated that the process of sewing stitch formation in apparel garments and other sewn industrial products is of great importance in determining the resulting sewn product integrity. Sewn product integrity is assured when quality standards of strength, safety and appearance are met. Applicants' stitch quality monitoring system can be used on-line to inspect garments as they are sewn and has the potential to consistently determine the level of sewn product integrity without the significant costs commonly associated with conventional manual inspection.

The quality of a sewn product is significantly affected by stitch defects such as loose stitches, poorly formed stitches, crowded stitches, tight stitches, crooked stitches and skipped stitches. All of these stitch defects are the result of out-of-control sewing machine conditions. For example, skipped stitches occur when the sewing stitch formation process is not successfully completed by the sewing machine. This can arise when timing errors occur in the sewing machine mechanism which forms the sewing stitch. Also, thread tension is another critical sewing machine parameter that can create stitch defects. As an example, insufficient needle thread tension may result in too much thread being pulled through the fabric by the looper thread and poorly formed stitches can result from the tension imbalance that decrease the strength of the sewn seam.

Applicants have met a long-felt need for a real time stitch quality monitoring system for quality control of sewing stitches that lends itself to use in manual as well as automated apparel manufacturing.

DISCLOSURE OF THE INVENTION

In accordance with the present invention, applicants provide a sewing machine having a stitch quality monitoring system that is operatively associated with the sewing machine. The stitch quality monitoring system comprises sensor means for at least one of the one or more stitch threads that detects certain thread motion characteristics during each stitch cycle and creates corresponding signals. The stitch quality monitoring system further comprises encoder means operatively associated with the sewing machine for generating a predetermined constant number of sensor means sampling signals for each stitch cycle of the sewing machine.

Circuit means is provided that is electrically connected to the sensor means and the encoder means and is adapted to detect stitch defects during the formation of potentially defective stitches.

Also, applicants provide a method for monitoring stitch quality on a sewing machine having one or more stitch threads and detecting stitch defects during the formation of the defective stitches that includes sensing certain movement characteristics of the one or more stitch threads with one or more corresponding sensor means during each stitch cycle and creating corresponding signals. The method for monitoring stitch quality further includes creating a predetermined constant number of sensor means sampling signals for each stitch cycle of the sewing machine with position sensing means, and analyzing the sensor means signals sampled by the position sensing means with computer means to detect stitch defects during the formation of potentially defective stitches.

Accordingly, it is an object of the present invention to provide a sewing machine having one or more stitch threads with a stitch quality monitoring system that immediately detects defective stitches as the stitches are being formed to allow defective stitches to be promptly corrected.

It is another object of the present invention to provide a sewing machine having one or more stitch threads with a stitch quality monitoring system that immediately detects defects in stitch formation to allow for immediate correction before the sewn product proceeds downstream and results in an off-quality item.

It is still another object of the present invention to provide a sewing machine having one or more stitch threads with a stitch quality monitoring system that obviates the costly and time-consuming step in apparel manufacturing of visual stitch and seam quality inspection.

It is still another object of the present invention to provide a sewing machine having one or more stitch threads with a stitch quality monitoring system that is unaffected by frequent changes in sewing machine speed, and lends itself for use in stitch quality monitoring in both manual and automated apparel manufacturing.

It is still another object of the present invention to provide a sewing machine having one or more stitch threads with a stitch quality monitoring system that can be easily retrofitted to existing sewing machines.

Some of the objects of the invention having been stated hereinabove, other objects will become evident as the description proceeds, when taken in connection with the accompanying drawings as best described hereinbelow.

BEST MODE FOR CARRYING OUT THE INVENTION

The process of sewing stitch formation in apparel garments and other sewn industrial products is of great importance in determining the resulting product integrity and acceptability. Applicants have developed an electronic real-time stitch quality monitoring system that can inspect a garment as it is sewn, and that consequently can consistently determine the level of sewn product integrity without the attendant costs commonly associated with the conventional visual stitch quality inspection procedure.

As noted hereinbefore, the quality of a sewn apparel or other industrial product is significantly affected by sewing stitch defects which can include loose stitches, poorly formed stitches, crowded stitches, tight stitches, crooked stitches and skipped stitches. These defects can result from out-of-control sewing machine conditions of operation. For example, skipped stitches can occur when the stitch formation process is not successfully completed, and this can arise when timing errors occur in the sewing machine mechanism that forms the stitch (e.g., in the formation of a chainstitch, the looper device may fail to catch the loop formed from the needle thread). Also, thread tension is another critical sewing parameter, and changes in tension can affect stitch formation very significantly (e.g., insufficient needle thread tension can result in too much thread being pulled through the fabric by the looper thread, and poorly formed stitches resulting from the tension imbalance can decrease the strength of the sewn seam).

Although others have used thread motion analysis in order to detect stitch defects by attempting to find a correlation between thread consumption and specific stitch and seam defects in sewn apparel products, applicants recognize that it is significantly more complex to attempt to identify single stitch defects as they occur in real time. In apparel and other sewn industrial product manufacturing, sewing speeds will typically constantly vary as the operator manipulates a garment through the sewing operation. This condition will significantly affect the ability of a stitch quality monitoring system to consistently identify stitch defects.

Applicants have developed a novel stitch quality monitoring apparatus and method that provides real time detection of stitch defects during the formation of the defective stitches in the sewing process. A detailed description of applicants' inventive apparatus and method are set forth hereinbelow and will be fully appreciated by one skilled in the textile and apparel manufacturing arts. Although applicants' invention can be used on substantially any type of sewing machine for personal or industrial use, applicants believe that the invention lends itself particularly to use in industrial manual and automated apparel manufacturing.

Stitch Quality Monitoring System Apparatus

Figure 1:
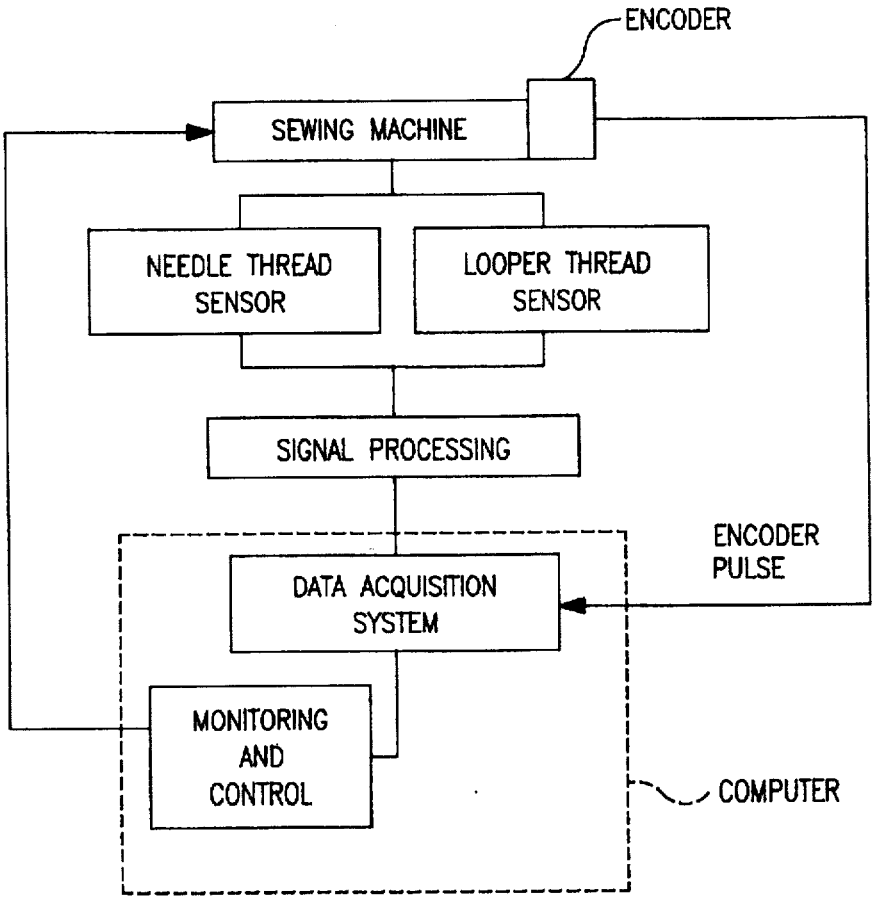
FIG. 1 is a schematic representation of the stitch quality monitoring system of the present invention.

A representative stitch quality monitoring apparatus (see FIG. 1) used to monitor stitch formation comprises four basic components. The components are as follows:

1. A UNION SPECIAL Model No. 35800 Side Arm Sewing Machine (or any other suitable sewing machine);
2. ELTEX Brand, Part No. 17040 Piezoelectric Transducers (one for each stitch thread of the sewing machine);
3. A QUICK-ROTAN Brand, Part No. PDI 62026 0588 Encoder; and
4. A suitably programmed VA RESEARCH Brand, Pentium, 90 $MH_z$ with LINUX operating system, Personal Computer.

To best understand applicants' invention, it will be appreciated that the UNION SPECIAL Side Arm Sewing Machine is commonly used in the production of a felled seam of the type that typically forms the inseam in pants and jeans. The sewing machine will form two independent rows of 401 type chainstitch wherein the top and bottom thread of each row are both continuous threads. The top thread is controlled by the needle of the sewing machine while the bottom thread is manipulated by a looper mechanism. The looper mechanism can best be described as a hook with an eye and thread channel, as will be fully appreciated by one skilled in the art. The motion of the looper allows the bottom or looper thread to form a loop through the needle thread loop which is formed as the needle penetrates through and then emerges from the fabric being stitched. The looper at this time also secures a loop from the previous looper cycle so as to create a chainstitch on the underside of the fabric which is dependent on subsequent stitches. From the topside of the fabric, the chainstitch will appear substantially identical to a lockstitch, but the bottom thread of the stitches will form a noticeably different configuration. Unlike the chainstitch, the lockstitch uses one continuous thread controlled by the needle and a finite length of thread contained on a bobbin to secure the needle thread on the underside of a fabric.

Applicants' novel stitch quality monitoring system utilizes low-cost, commercially available ELTEX Brand, Part No. 17040 piezoelectric sensors for both the top thread and looper thread of the sewing machine. Although the preferred embodiment of the invention utilizes two stitch threads with two corresponding piezoelectric sensors, applicants contemplate that the sewing machine can also utilize one stitch thread or three or more stitch threads, and a piezoelectric sensor will be operatively associated with at least one and preferably with each stitch thread. The piezoelectric sensors are designed to detect yarn breaks or stops in weaving and knitting applications, but applicants have discovered that the units can also easily be adapted for sewing thread detection as required by the instant invention.

The piezoelectric sensors are approximately 10.0 cm×3.81 cm×1.30 cm in size with a protruding ceramic eyelet through which a stitch thread passes. Each stitch thread passes through the eyelet of a corresponding piezoelectric sensor located (most suitably) beyond any thread tensioning devices. The piezoelectric sensors are mounted beyond the tensioning devices to assure that contact is made with the surface of the transducer sensor by the stitch thread passing therethrough. Any momentary loss of contact between the stitch thread and the transducer sensor surface can result in undesirable obscured readings, and the possibility of losing contact between the stitch thread and the transducer sensor can be eliminated by the proper positioning of the transducer sensor eyelet beyond the sewing machine's disk tensioners.

Figure 6A:
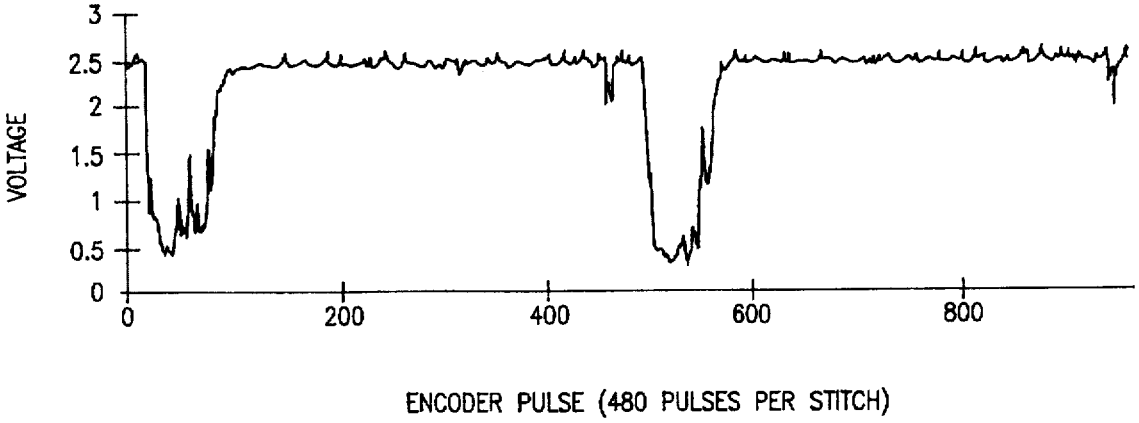
FIG. 6A and 6B are charts depicting needle thread motion at 2.5 stitches per second for 2 properly formed stitches and a skipped stitch over two stitch cycles, respectively.
Figure 6B:
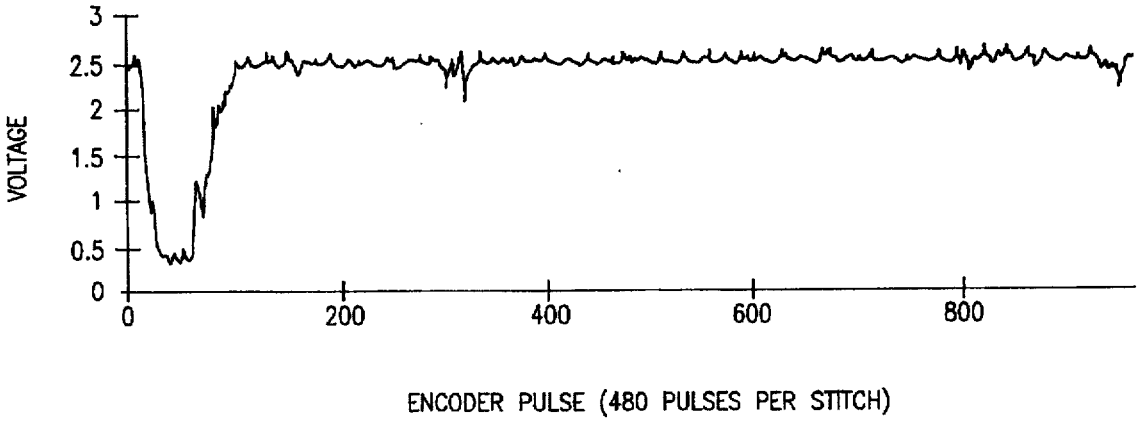

The piezoelectric sensors are designed to detect levels of vibration and yield an output voltage consistent with the level of vibration. Thus the sensors will respond to the vibration resulting from thread motion and output a corresponding wave form signal. In addition to looking for breaks or stops of the stitch thread, the stitch quality monitoring system will also sample the analog outputs of the transducer sensor units to indicate the behavior of the stitch thread motion during sewing (see FIGS. 2–4). Thread motion will appear as a voltage drop in the output waveform while the absence of stitch thread motion will appear as a constant voltage. The waveforms from the piezoelectric sensors can then be matched to those of properly formed stitches to determine any discrepancies indicating stitch defects by a suitably programmed personal computer (PC). FIGS. 6A and 6B, discussed hereinbelow, show a properly formed stitch and an improperly formed stitch, respectively, wherein the needle thread is being monitored.

Applicants contemplate the use of suitable signal processing electronics to prepare the signals from the piezoelectric transducer sensors for proper sampling and subsequent analysis by the electrically associated personal computer (PC) or other electronic circuitry. The signal processing electronics most suitably can include an operational amplifier such as the HARRIS Brand, Model No. LM324N amplifier to amplify and isolate the signal output from the piezoelectric sensors. Data acquisition is achieved by the PC. A COMPUTER BOARDS brand Part No. CIO-DAS1602/12 data acquisition board in the PC consists of several analog to digital (A/D) conversion channels to read the signal output of each piezoelectric sensor, and further includes digital output capabilities for control and automation of the sewing process as may be desired.

The encoder is attached to the flywheel on the end of the main shaft of the sewing machine and provides an external trigger or pulse to achieve one or more samples at precise displacement positions through each rotation of the main shaft which corresponds to the formation of an individual stitch. The QUICK-ROTAN encoder is used to provide a start pulse and 480 subsequent pulses within each rotation of the sewing machine main shaft. At these precise displacement positions the piezoelectric sensor signals are acquired and analyzed by the suitable programmed PC. The PC provides a digital output that can be used to control the sewing portion of the apparel manufacturing process in a manner that would be understood by one skilled in the art, for example by varying sewing speeds to correspond to a desired high quality stitch formation. The control can be accomplished by suitable programming of the PC.

Although applicants have described use of signal processing hardware and a suitable programmed PC for processing acquisition and analysis of sensor signal data, applicants also contemplate that a microprocessor or other electronic circuitry could be utilized to perform these functions and is intended to be within the scope of the present invention.

Stitch Quality Monitoring System Operation

Applicants have developed a sampling method to detect the presence of stitch thread defects during the formation of the defective stitches by sampling the analog signal output of the piezoelectric transducer sensors. The sampling method is highly novel and will be described in detail hereinbelow.

In the specific sewing machine arrangement described in the detailed description of the invention, the needle bar and looper mechanism are both connected to the main shaft of the sewing machine that is in turn rotated by the sewing machine motor. As is well known to those skilled in the art, one revolution of the main sewing machine shaft corresponds to one sewing stitch cycle. Applicants' invention provides for attaching the encoder to the flywheel on the end of the main shaft of the sewing machine. Thus, the encoder will provide signal pulses at both the beginning and end of the sewing stitches, as well as at predetermined relative positions within a stitch cycle. The sewing machine motor controllers utilize the encoder signals to identify the sewing machines' position within a stitch cycle as well as for speed control purposes.

The UNION SPECIAL sewing machine utilizes an encoder capable of outputting a Transistor Transitor Logic (TTL) level pulse 480 times for each revolution of the main shaft of the sewing machine. The data acquisition system uses this signal to sequence the A/D conversion of samples on high to low transitions of the pulse. As a result, all sampling effects relating to speed will be eliminated by the stitch quality monitoring system of the present invention by providing a consistent number of data points in each revolution (e.g., each stitch) regardless of the speed of the sewing machine. Thus, in addition to eliminating the effects of variable sewing machine speed, applicants' novel sampling methodology provides more detailed information regarding the detection of single stitch defects. Finally, it should be understood that the data acquisition system is programmed to simultaneously sample each piezoelectric sensor output created by each stitch thread when each high to low transition from the encoder signal is detected.

Test Results of the Stitch Quality Monitoring System

Figure 2:
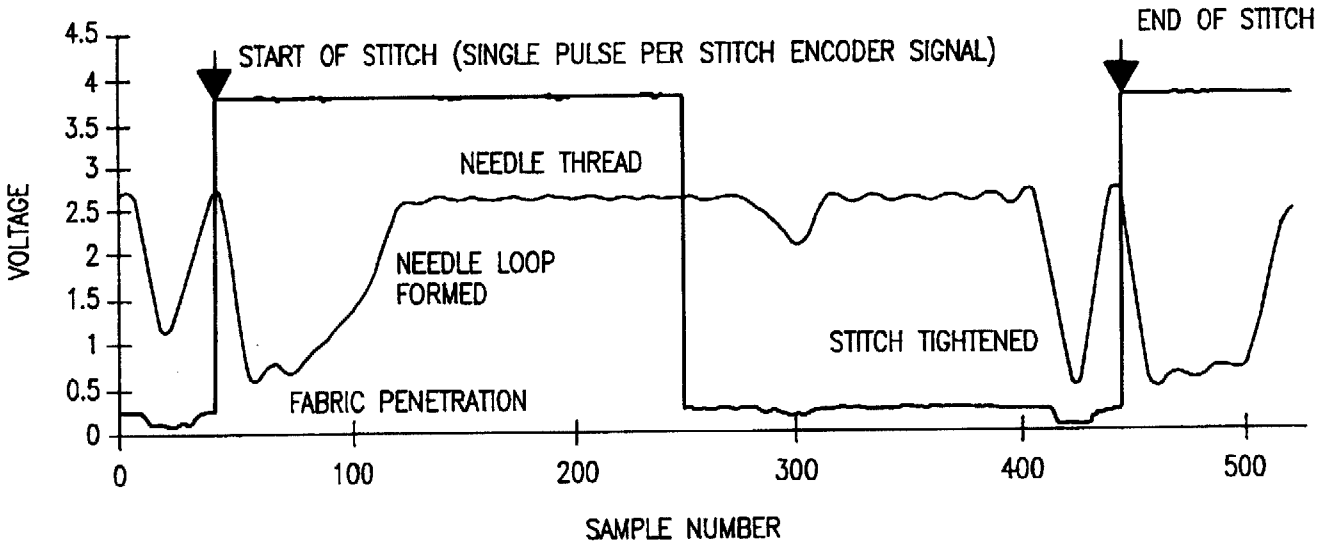
FIG. 2 is a chart depicting needle thread motion during a single sewing machine stitch.

Applicants have tested the apparatus and method of the present invention on twill denim with the apparatus described hereinabove with sewing speeds of 2.5 and 9.4 stitches per second. Testing demonstrated that the two piezoelectric sensors used for the needle thread and looper thread, respectively, are effective to monitor the behavior of the needle and looper stitch thread motions during stitch formation. Although analyzing the motions of the needle thread and looper thread with respect to the machine position within stitch cycles, applicants discovered that specific events in the formation of a single stitch can also be identified (e.g., the penetration of the fabric by the needle thread and the formation of the loop). The output waveform from the needle thread describing a single stitch is shown in FIG. 2. The once per stitch cycle encoder pulse identifying the length of the single stitch is included in FIG. 2 for reference purposes and to more accurately define events within the stitch cycle.

Referring again to FIG. 2, the encoder will indicate the beginning of the stitch cycle by voltage drop from a constant level. The stitch cycle begins with the movement of the needle thread through the fabric to a position where it will be secured by the looper thread to form the stitch. The movement of the top stitch thread required to form a loop on the underside of the fabric is indicated by a significant drop in the piezoelectric sensor output (see FIG. 2). The needle then pulls a top thread back up through the fabric to complete the stitch, and pulls the stitch thread tight to secure the newly formed sewing stitch. The constant voltage level observed from the piezoelectric sensor in the middle of the stitch cycle is significant since it represents a considerable pause in the motion of the top thread as the looper mechanism penetrates the needle thread loop. Applicants note that since these events are periodic and describe a successfully completed stitch, the absence of such features in the waveform or any departure from this periodic nature aid in identifying single stitch defects of the type described hereinabove. Sudden changes in the waveform correspond to abrupt changes in the direction or speed of the stitching thread, and such changes may be caused by high levels of tension exerted on the needle thread or resistance from the fabric or looper thread. The influence of each thread on the other stitching thread demonstrates the desirability of analyzing both stitching threads simultaneously with independent piezoelectric sensors with the stitch quality monitoring system of the present invention.

Figure 3:
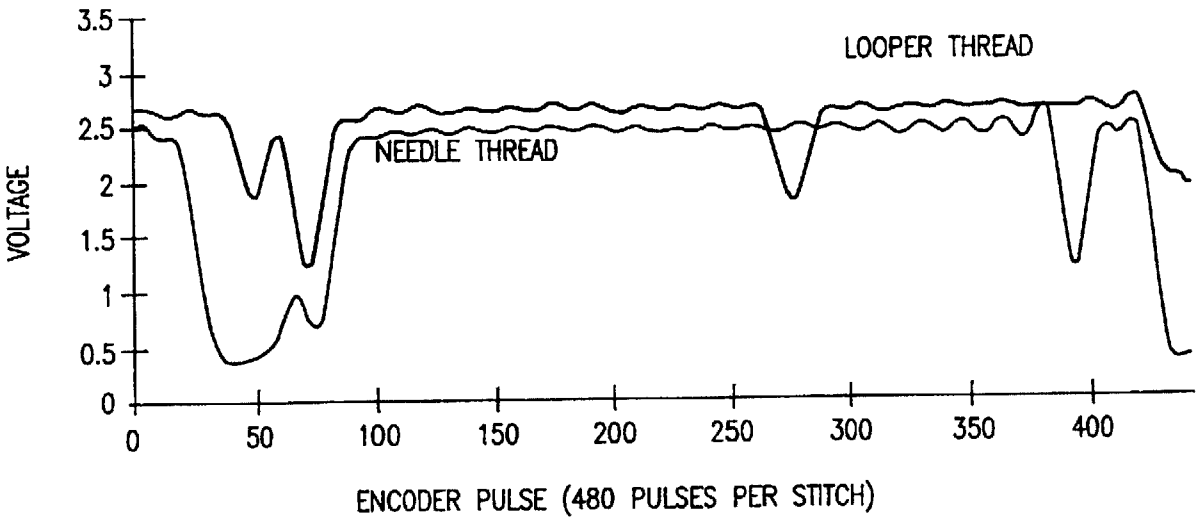
FIG. 3 is a chart depicting both needle and looper thread motion during a single sewing machine stitch for one (1) denim ply.
Figure 4:
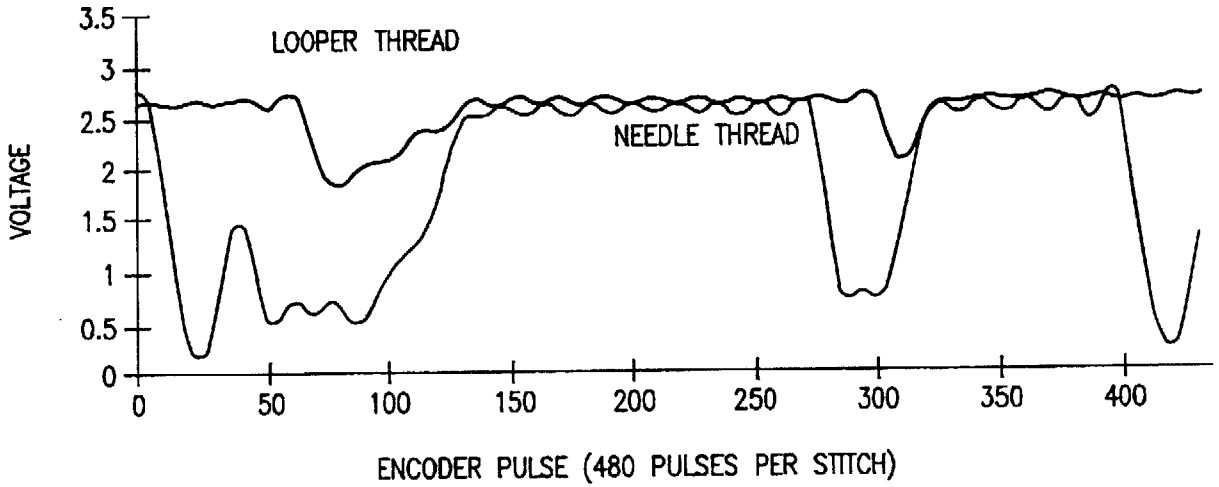
FIG. 4 is a chart depicting both needle and looper thread motion during a single sewing machine stitch for four (4) denim plies.

The motion of both the needle thread and the looper thread for a proper stitch through one ply of denim fabric is shown in FIG. 3 and through four plies of denim fabric is shown in FIG. 4.

Along with the characteristics described previously for the top thread, the waveform of the top thread in FIG. 3 indicates the motion of the looper thread as well. Once the needle thread is pulled through the fabric, the looper thread advances to penetrate the needle loop thread and form the stitch. Further, looper thread motion can be noticed while the needle thread is stationary, and this motion indicates movement forward in preparation for the next stitch. This indicates that the stitch is formed in the early stages of the stitch cycle, and the sudden changes in needle thread and looper thread motion observed immediately following the voltage drop from the encoder support this indication. As the stitch threads loop through and around one another to create the actual stitch, applicants note that changes in motion, speed and tension occur as the stitch threads make contact and interact.

Referring now to FIG. 4, applicants note that an increase in thread consumption is required to secure the four denim plies, and the increase can be identified in FIG. 4 as the top stitch thread is in motion for a larger portion of the first half of the stitch cycle. Thus, the portion of the cycle that the stitch threads are stationary is reduced, and this changes the point in the stitch cycle when the stitch threads advance in preparation for the next stitch. This is significant since it demonstrates the ability to identify or diagnose the presence of additional plies or missing plies of denim during product construction.

Figure 5A:
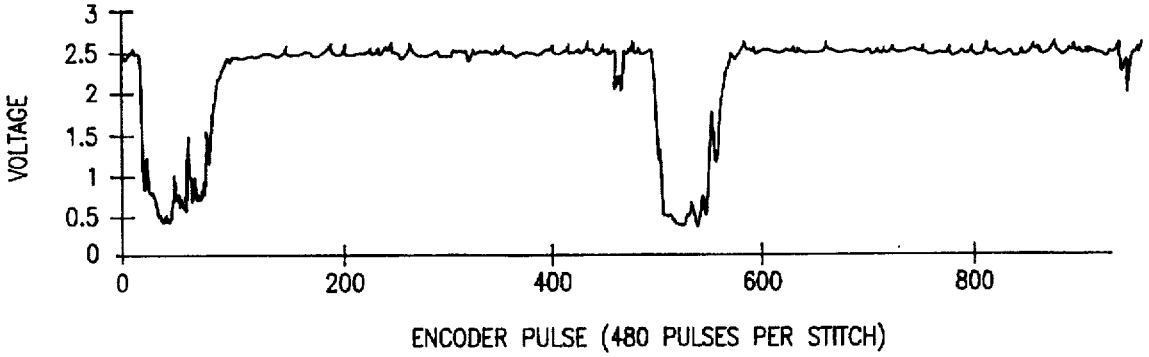
FIGS. 5A and 5B are charts depicting needle thread motion through one (1) ply of fabric at 2.5 and 9.4 stitches per second, respectively.
Figure 5B:
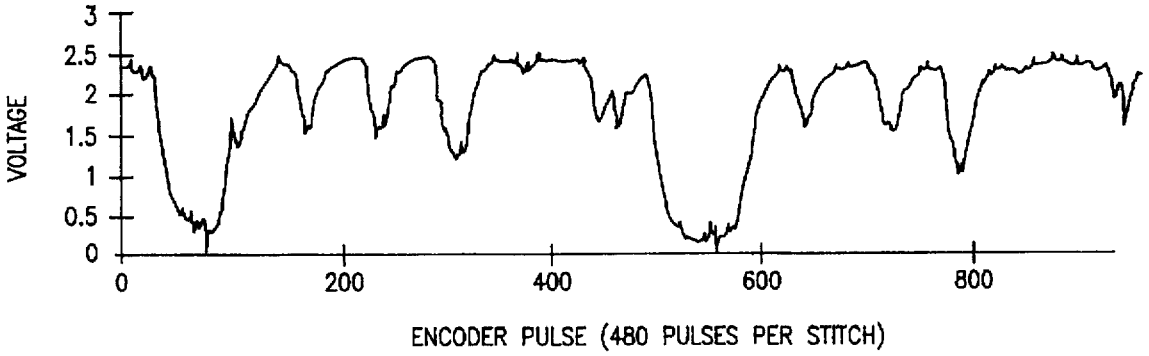

The motion of the needle thread through one ply of fabric at speeds of 2.5 and 9.4 stitches per second, respectively, is shown in FIGS. 5A and 5B. As discussed previously, the A/D conversion of samples was timed on high-to-low transitions of the sewing machine's encoder pulse. Consequently, 480 samples were collected for each stitch, regardless of speed. FIGS. 5A and 5B are important because they demonstrate the effectiveness of the sampling method in eliminating undesirable effects caused by varying sewing speeds. There are noticeable differences in the waveforms of FIGS. 5A and 5B due to the sewing dynamics, however they do not contribute to the identification of a correctly or incorrectly formed stitch. The most important aspect to note is the ability to exactly pinpoint the start of each stitch, allowing for the recognition of proper thread motion during each relevant portion of the stitch cycle.

Two stitch intervals with a skipped stitch are compared to two proper stitch intervals for the needle thread in FIGS. 6B and 6A, respectively. With the encoder-based sampling method, the movement of the needle thread down through the fabric can be identified at its proper position in the stitch cycle in FIG. 6A. However, in FIG. 6B, this movement at the beginning of the second stitch cycle is clearly absent. This absence indicates the occurrence of a skipped stitch. A skipped stitch occurs when, after penetrating the fabric, the needle thread loop fails to be caught by the looper thread. However, the needle thread will usually be caught by the looper thread at the beginning of one of the following stitch cycles. Applicants observe that the reason skipped stitches can be so difficult to detect is that from the top side of the fabric they may appear to be normal stitches if the unsecured needle thread remains looped through the fabric. With the displacement-based method of sampling of the invention, this particular defect can be easily identified by monitoring the correct portion of every stitch cycle.

Figure 7A:
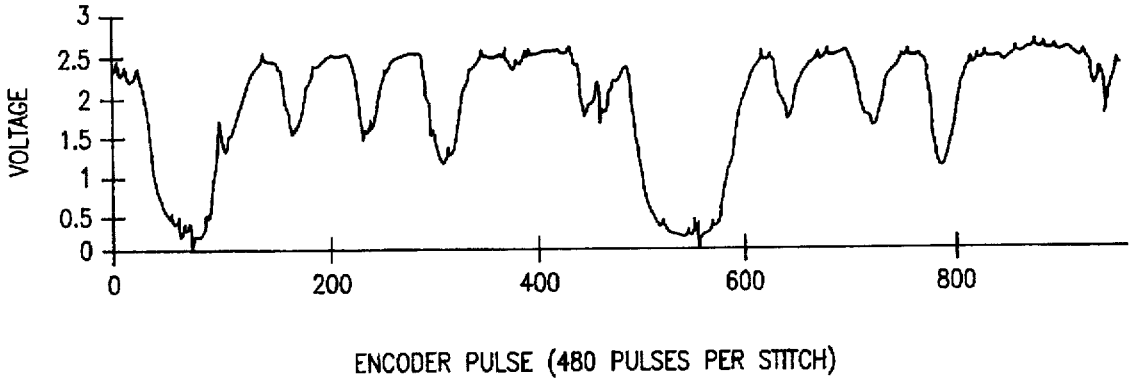
FIGS. 7A and 7B are charts depicting needle thread motion at 9.4 stitches per second for properly formed stitches and a skipped stitch over two stitch cycles.
Figure 7B:
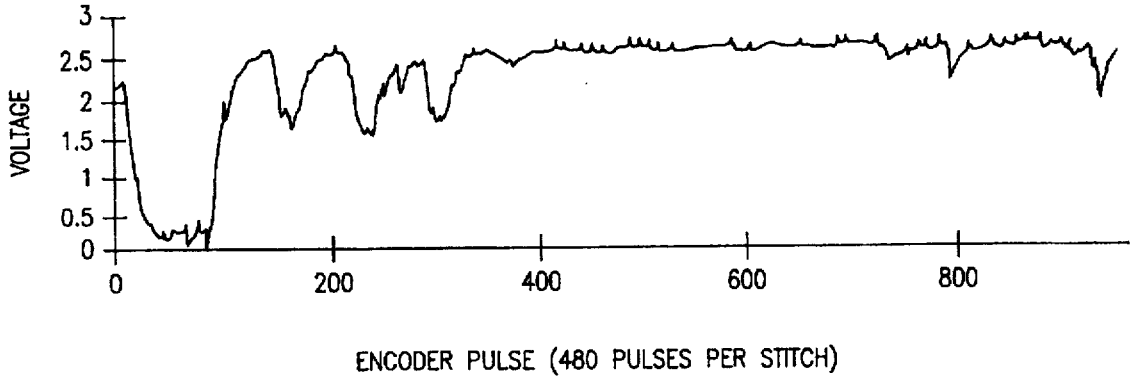

Examples of a skipped stitch at a higher sewing speed of 9.4 stitches per second is shown in FIGS. 7A and 7B. FIG. 7A represents two proper stitch cycles, while FIG. 7B represents a skipped stitch over two stitch cycles. As in the case of the lower sewing speed, the skipped stitches are identified by the absence of the needle thread movement through the fabric at the proper point in the stitch cycle. Along with FIGS. 5A and 5B, this illustrates the irrelevance of speed with this sampling method. With time-based sampling it would be difficult to locate the most crucial position within the stitch cycle without involved computation. This becomes extremely important when considering the on-line monitoring capabilities of such a system.

Applicants again note that the waveforms from the sensors during stitch formation will be matched to waveforms of properly formed stitches to detect stitch defects by a suitably programmed PC, a microprocessor or other suitable electronic circuitry.

It will be understood that various details of the invention may be changed without departing from the scope of the invention. Furthermore, the foregoing description is for the purpose of illustration only, and not for the purpose of limitation--the invention being defined by the claims.

What is claimed is:

1. In combination, a sewing machine having one or more stitch threads and a stitch quality monitoring system, said stitch quality monitoring system comprising:

(a) sensor means in at least substantially continuous contact with at least one of said one or more stitch threads for detecting certain thread motion characteristics by detecting vibration resulting from motion of said one or more stitch threads during each stitch cycle and creating corresponding signals;

(b) encoder means operatively connected to said sewing machine for generating a predetermined constant number of sensor means sampling signals for each stitch cycle of said sewing machine; and (c) circuit means electrically connected to said sensor means and said encoder means for detecting stitch defects during the formation of potentially defective stitches including defects from fluctuations in tension of said one or more stitch threads.

2. The combination according to claim 1 wherein said sewing machine comprises a plurality of stitch threads and said sensor means is provided for each of said plurality of stitch threads.

3. The combination of claim 2 wherein said plurality of stitch threads comprises two stitch threads.

4. The combination according to claim 1 wherein said sewing machine comprises a plurality of stitch threads and said sensor means is provided for one of said plurality of stitch threads.

5. The combination of claim 1 wherein said sensor means comprises a piezoelectric transducer.

6. The combination of claim 1 wherein said circuit means comprises a computer for analyzing said sensor means signals.

7. The combination of claim 1 wherein said circuit means comprises a microprocessor for analyzing said sensor means signal.

8. The combination of claim 1 wherein said sewing machine comprises a plurality of stitch threads and a corresponding plurality of sensor means operatively associated therewith and said circuit means simultaneously analyzes signals from said plurality of sensor means.

9. The combination of claim 1 wherein said circuit means includes control means operatively connected to said sewing machine to control one or more predetermined functions of said sewing machine in response to said analyzed signals from said sensor means.

10. In combination, a sewing machine having a plurality of stitch threads and a stitch quality monitoring system, said stitch quality monitoring system comprising:

(a) sensor means in at least substantially continuous contact with at least one of said plurality of stitch threads for detecting certain thread motion characteristics by detecting vibration resulting from motion of said one or more stitch threads during each stitch cycle and creating corresponding signals;

(b) encoder means operatively associated with said sewing machine for generating a predetermined constant number of sensor means sampling signals for each stitch cycle of said sewing machine; and (c) computer means electrically connected to said sensor means and said encoder means for analyzing said sensor means signals to detect stitch presence or absence as well as to detect stitch defects during the formation of potentially defective stitches including defects from fluctuations in tension of said one or more stitch threads.

11. The combination according to claim 10 wherein said sewing machine comprises two stitch threads and sensor means is provided for each of said two stitch threads.

12. The combination according to claim 10 wherein said sewing machine comprises a plurality of stitch threads and said sensor means is provided for one of said plurality of stitch threads.

13. The combination of claim 10 wherein said sensor means comprises a piezoelectric transducer.

14. The combination of claim 10 wherein said computer means comprises a personal computer (PC).

15. The combination of claim 10 wherein said computer means comprises a microprocessor.

16. The combination of claim 10 wherein said sewing machine comprises a plurality of sensor means operatively associated with a corresponding plurality of stitch threads and said computer means simultaneously analyzes signals from said plurality of sensor means.

17. The combination of claim 10 wherein said computer means includes control means operatively connected to said sewing machine to control one or more predetermined functions of said sewing machine in response to said analyzed signals from said sensor means.

18. A method for monitoring stitch quality on a sewing machine having one or more stitch threads and detecting stitch defects during the formation of the defective stitches, the method comprising the steps of:

(a) sensing during each stitch cycle certain movement characteristics of said one or more stitch threads by detecting vibration resulting from motion of said one or more stitch threads with one or more sensor means in at least substantially continuous contact with said one or more stitch threads and creating corresponding signals;

(b) creating a predetermined constant number of sensor means sampling signals for each stitch cycle of said sewing machine with position sensing means; and (c) analyzing said sensor means signals sampled by said position sensing means with circuit means to detect stitch defects during the formation of potentially defective stitches including defects from fluctuations in tension of said one or more stitch threads.

19. The method according to claim 18 comprising sensing certain movement characteristics of a plurality of stitch threads with a corresponding plurality of sensor means during each stitch cycle.

20. The method according to claim 20 comprising sensing movement of said plurality of stitch threads with said corresponding plurality of sensor means during each stitch cycle and simultaneously analyzing said sensor means signals from said plurality of sensor means to detect stitch defects during the formation of defective stitches.

21. The method according to claim 18 comprising sensing certain movement characteristics of one of said plurality of stitch threads with one sensor means during each stitch cycle.

22. The method according to claim 18 wherein said sensor means comprises a piezoelectric transducer.

23. The method according to claim 18 wherein said position sensing means comprises an encoder.

24. The method according to claim 18 wherein said circuit means comprises a computer.

25. The method according to claim 18 wherein said computer means comprises a microprocessor.

26. The method according to claim 18 including controlling one or more predetermined functions of said sewing machine by said computer means in response to said analyzed signals from said sensor means.

* * * * *